US005447899A

United States Patent [19]

Matoba et al.

[11] Patent Number: 5,447,899

[45] Date of Patent: Sep. 5, 1995

[54] HEAT-SENSITIVE RECORDING MATERIAL

[75] Inventors: Gensuke Matoba, Chiba; Ichiro Matsuoka, Amagasaki, both of Japan

[73] Assignee: New Oji Paper Co., Ltd., Tokyo, Japan

[21] Appl. No.: 249,807

[22] Filed: May 26, 1994

[30] Foreign Application Priority Data

May 28, 1993 [JP] Japan ..... 5-126821

[51] Int. Cl.[6] ..... B41M 5/40

[52] U.S. Cl. ..... 503/200; 427/152

[58] Field of Search ..... 427/150, 151, 152; 503/200, 226; 428/537.5

[56] References Cited

FOREIGN PATENT DOCUMENTS 59-33180 2/1984 Japan ..... 503/200

*Primary Examiner*—Bruce H. Hess

*Attorney, Agent, or Firm*—Morgan & Finnegan

[57] ABSTRACT

A heat-sensitive recording material is prepared by forming a heat-sensitive recording layer on a synthetic paper having a laminated structure. The synthetic paper has a front surface having a smoothness (in accordance with JIS P-8119) of not less than 2000 seconds on which the heat-sensitive recording layer is provided, and a back surface having a smoothness of not more than 1000 seconds, and has an opacity (in accordance with JIS P-8138) of not higher than 40%. The heat-sensitive recording material is superior in recording runnability and recording quality, and gives recorded materials useful as a second original for diazo print.

8 Claims, 1 Drawing Sheet

HEAT-SENSITIVE RECORDING MATERIAL

BACKGROUND OF THE INVENTION

This invention relates to a heat-sensitive recording material and more particularly to a heat-sensitive recording material in which a synthetic paper is used as a base sheet and which is superior in recording runnability and recording quality, and gives recorded materials useful as a second original for diazo print.

According to the development of manufacturing technology of semiconductor, a wide single thermal head could be manufactured efficiently at a low cost as a thermal head used in heat-sensitive recording system. Since thermal plotters equipped with the head can print wide letters with a high printing speed and require no maintainance, they have gradually supplanted conventioanl pen plotters.

Further, images recorded by these plotters are mainly the figures drawn by CAD and used as the originals for diazo duplication. Accordingly, as the recorded materials are supplied as the secondary originals for diazo duplication, a somewhat transparency is required for the medium. A semitransparent or transparent heat-sensitive recording material in which a transparent film is used as the support has been required as a medium for heat-sensitive recording system.

On the other hand, the wide thermal plotter mentioned above is different from usual heat-sensitive equipments such as facsimile and the like. In the case, the medium is generally transferred by driving a driving roll equipped downstream of the nip portion between the thermal head and the platen roll as shown in FIG. 1. When the recording is made on a heat-sensitive recording material using a transparent film as the support in such a thermal plotter, the driving roll idles at the nip portion between the driving roll and the plate usually Teflon-lined and troubles of abnormal transfer of the heat-sensitive recording material occur in a high frequency.

The cause of the trouble can be assumed that, though the reverse surface of the heat-sensitive recording material using a transparent film as the support is usually not processed or back-coated to some g/m$^2$, the support has a very high smoothness compared to paper and common synthetic paper even if back-coated, and therefore the reverse surface of the heat-sensitive recording material adheres tightly with the plate surface at the nip portion between the driving roll and the plate so that the driving roll idles. As a countermeasure for this trouble, it can be considered that a pigment of relatively large particle size is added to the back coat layer to roughen the reverse surface of the heat sensitive recording material. However, this method lowers largely transparency, though it shows some effect on the improvement of runnability and it cannot be a practical means for improvement. When a paper-based support of high transparency, for example, a glassine paper, is used, the recording surface is also rough and therefore the heat-sensitive recording layer formed on it becomes also rough to deteriorate the recording quality disadvantageously.

The object of the present invention is to provide a heat-sensitive recording material which is superior in recording runnability and recording quality and gives recorded materials useful as a second original for diazo print.

SUMMARY OF THE INVENTION

A heat-sensitive recording material according to the invention is prepared by forming a heat-sensitive recording layer on a synthetic paper having a laminated structure. The synthetic paper has a front surface having a smoothness (in accordance with JIS P-8119) of not less than 2000 seconds on which the heat-sensitive recording layer is provided, and a back surface having a smoothness of not more than 1000 seconds, and has an opacity (in accordance with JIS P-8138) of not higher than 40%, preferably not higher than 20%.

The synthetic paper may be constituted of two or more layers of thermoplastic resin films.

DETAILED DESCRIPTION OF THE INVENTION

The smoothness of the front surface of synthetic paper used in the invention, on which a recording layer is formed, is not lower than 2,000 seconds, preferably 2,000 to 50,000 seconds, more preferably 2,000 to 30,000 seconds. The smoothness of lower than 2,000 seconds deteriorates the recording quality, and the smoothness of higher than 50,000 seconds is liable to make the heat-sensitive recording layer's surface too smooth to maintain a stable runnability during the recording step.

On the other hand, the smoothness of the back surface of synthetic paper used in the invention is not higher than1,000 seconds, preferably 50 to 1,000 seconds, more preferably 50 to 800 seconds. The smoothness higher than 1000 seconds lowers the conveyability of the heat-sensitive recording material, and the smoothness of lower than 50 seconds generally increases the opacity of the product.

Further, the opacity of the synthetic paper used in the invention is not higher than 40%, preferably 9 to 40%, more preferably 9 to 20%. An opacity higher than 40% makes a heat-sensitive recording material too opaque to apply the recorded material to diazo copying. The opacity is preferred to be lower, but 9% is the lowest value measured by JIS P-8138.

The number of the resin layers having fine pores and the number of the layers constituting the synthetic paper are not restricted. The thickness of the synthetic paper is not particularly restricted but it is preferably 30 to 290 μm, more preferably 60 to 125 μm.

In general, a synthetic paper of laminated structure is prepared as follows. First, a synthetic resin is mixed with a substance incompatible with the resin and the mixture is melted and milled in an extruder and then extruded from a die slit and the resultant film is drawn successively longitudinally to prepare a uniaxially drawn film having fine pores. Then, a film prepared by mixing a synthetic resin with a substance incompatible with the resin and melting and milling the mixture in an extruder and extruding it from a die slit is laminted on one side or both sides of the uniaxially drawn film and the film of laminated structure is drawn successively transversely to prepare a synthetic paper of laminated structure. A synthetic paper of laminated structure having desired smoothness and transparency can be prepared by controlling the types and the ratios of the synthetic resins and the substances incompatible with said resins constituting each layers, the drawing ratio and the temperature in each drawing steps and the method for smoothing after drawn transversely.

Although a synthetic paper of 2 or 3 layer structure having fine pores formed during drawing is prepared by the above-mentioned method as a substance incompatible with the resin is added to each of all resins, any or all of the layers can be made to be a layer containing no fine pores by drawing it with no addition of an incompatible substance.

For example, in the case of the synthetic paper constituted of two layers, the preferable laminated structure is constituted of two thermoplastic film layers, the front layer of which contains 0 to 10% by weight of fine inorganic powders and has a thickness of 30 to 250 μm and the back layer of which contains 5 to 50% by weight of fine inorganic powders and has a thickness of 1 to 20 μm. Preferably, the front layer is biaxially drawn and the back layer is uniaxially drawn.

On the other hand, in the case of the synthetic paper constituted of three layers, the preferable laminated structure comprises a basic layer and two paper-like layers respectively laminated on the front and back surfaces of the basic layer, the basic layer is a thermoplastic resin film containing 0 to 10% by weight of fine inorganic powders, the front paper-like layer on which a heat-sensitive recording layer is formed is a thermoplastic resin film containing 0 to 5% by weight of fine inorganic powders, and the back paper-like layer is a thermoplastic resin film containing 5 to 50% by weight of fine inorganic powders.

It is preferred that the thermoplastic resin film as the basic layer is biaxially drawn and the thermoplastic resin films as the paper-like layers are uniaxially drawn. In such a synthetic paper constituted of a biaxially drawn basic layer and uniaxially drawn layers respectively laminated on both surfaces of a biaxially drawn basic layer, it can be easily torn in one direction and has a good dimensional stability to keep the recorded images uniform.

Preferably, the basic layer has a thickness of 30 to 250 μm, and each of the paper-like layers has a thickness of 1 to 20 μm.

As the fine inorganic powders which may be comprised in the synthetic paper, there are exemplified calcium carbonate, calcined clay, diatomaceous earth, talc, titanium oxide, barium sulfate, ammonium sulfate and silica. The particle size is generally not larger than 12 μm.

Among the useful synthetic resins, there are included commonly used synthetic resins such as polyolefin, polyamide, polyester and polyvinyl chloride. Polyolefin resins are preferred as they can be easily made to film and are economical. Exemplified as the polyolefin resins are polyethylene, polypropylen, their copolymers and further their mixtures. Polymer particles and inorganic pigments incompatible with the above-mentioned synthetic resin can be used as the substance incompatible with the synthetic resin and inorganic pigments are preferably used as their dispersibility in the synthetic resin and easiness of film-forming and economics.

The synthetic paper constituted as above is used as a support for a heat-sensitive recording material and a heat-sensitive recording layer is provided usually directly on the surface of said support having a smoothness of not lower than 2,000 seconds. However, in the case of that the adhesion of the synthetic paper to the heat-sensitive recording layer is poor or the wettability index of the synthetic paper surface is low, an intermediate layer such as an anchor coat layer and an adhesion layer may be provided.

A heat-sensitive recording layer is provided on the synthetic paper thus prepared. Any combination of the developing agent and the coloring agent constituting the heat-sensitive recording layer can be used if they contact to cause a color reaction. They include, for example, a combination of a colorless or light-colored basic chromogenic material and an acid substance, a combination of a higher fatty acid metal salt such as ferric stearate and a phenol such as gallic acid, a combination of a diazonium compound, a coupler and a basic substance and a combination of an aromatic isocyanate and an amino compound. A combination of a colorless or light-colored basic chromogenic material and an acid substance is preferred as it exerts a particularly remarkable effect on the synthetic paper specified by the present invention.

As the colorless or light-colored basic chromogenic materials, various ones have been known and they include, for example, the following compounds: triarylmethane compounds such as 3,3-bis(p-dimethylaminophenyl)-6-dimethylaminophthalide, 3,3-bis(p-dimethylaminophenyl)phtalide, 3-(p-dimethylaminophenyl)-3-(1,2-dimethylindol-3-yl)phthalide, 3-(p-dimethylaminophenyl)-3-(2-methylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-6-dimethylaminophthalide, 3,3-bis(2-phenylindol-3-yl)-6-dimethylaminophthalide and 3-p-dimethylaminophenyl-3-(1-methylpyrrol-3-yl)-6-dimethylaminophthalide; diphenylmethane compounds such as 4-4'-bis-dimethylaminobenzhydryl benzyl ether, N-halophenyl-leucoauramines and N-2,4,5-trichlorophenyl-leucoauramine; thiazine compounds such as benzoylleucomethylene blue and p-nitrobenzoylleucomethylene blue; spiro compounds such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho(6'-methoxybenzo) spiropyran and 3-propyl-spiro-dibenzopyran; lactam compounds such as Rhodamine B-anilinolactam, Rhodamine(p-nitroanilino)lactam and Rhodamine(o-chloroanilino)lactam; and fluoran compounds such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxy-phenylamino)fluoran, 3-(N-cyclohexyl-N-methylamino)-6-methyl-7-phenylaminofluoran, 3-pyridino-6-methyl-7-phenylaminofluoran, 3-piperidino-6-methyl-7-phenylaminofluran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-β-ethylhexyl- )amino-6-methyl-7-phenylaminofluoran, 3-(N-ethyl-N-tetrahydrofurfuryl)amino-6-methyl-7-phenylaminofluoran and 3-(N-ethyl-N-ethoxypropyl)amino-6-methyl-7-phenylaminofluoran. The chromogenic materials are not restricted to the above. At least two of them can be also used in combination if required.

Various acid compounds have been known as color developing agents used in combination with the above basic chromogenic materials. Among them, there are exemplified the following compounds: phenolic compounds such as 4-tert-butylphenol, α-naphthol, β-naphthol, 4-acetylphenol, 4-tert-octylphenol, 4,4'-dihydroxy-diphenylmethane, hydroquinone, 4,4'-isopropylidenediphenol, 4,4'-cyclohexylidenediphenol, 4,4'-(1,3-dimethylbutylidene)bisphenol, 4.4'-dihydroxydiphenylsulfide, 4,4'-thiobis(6-tert-butyl-3-methylphenol), 4,4'-dihydroxydiphenylsulfone, 4-hydroxy-4'-methoxydiphenylsulfone, 4-hydroxy-4'-isopropoxydiphenylsulfone, 4-hydroxy-3',4'-trimethylenediphenylsulfone, 4-hydroxy-3',4'-tetramethylenediphenylsulfone, 3,4-dihydroxy-4'-methyldiphenylsulfone, bis(3-allyl-4-hydroxyphenyl)sulfone, 1,3-di[2-(4-hydroxyphenyl)-2-propyl]benzene, hydroquinone monobenzyl ether, butyl bis(4-hydroxyphenyl)acetate, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, trichlorophenyl 4-hydroxybenzoate, phenylpropyl 4-hydroxybenzoate, phenethyl 4-hydroxybenzoate, p-chlorobenzyl 4-hydroxybenzoate, novolac phenol resins and phenol polymers; aromatic carboxylic acids such as benzoic acid, p-tert-butylbenzoic acid, trichlorobenzoic acid, terephthalic acid, 3-sec-butyl-4-hydroxybenzoic acid, salicylic acid, 3-isopropylsalicylic acid, 3-tert-butylsalicylic acid, 3,5-di-tert-butylsalicylic acid, 3-benzylsalicylic acid, 3-(α-methylbenzyl)salicylic acid, 3-chloro-5-(α-methylbenzyl)salicylic acid and 3-phenyl-5-(α, α-dimethylbenzyl)salicylic acid; and salts of these phenolic compounds and aromatic carboxylic acids with polyvalent metals such as zinc, magnesium, aluminum, calcium, titanium, manganese, tin and nickel. These developing agents and coloring agents can be used in combination of at least two if required.

The ratio of the developing agent to the coloring agent used is properly selected depending on their types and not particularly restricted. When a basic chromogenic material and an acid substance are used, it is generally preferred to use 100 to 700 parts by weight, more preferably 150 to 200 parts by weight of the acid substance based on 100 parts by weight of the basic chromogenic material.

The coating composition containing these substances is prepared by dispersing the developing agent and the coloring agent together or separately in a stirring pulverizer such as a ballmill, an attritor and a sand mill by using water as the dispersion medium.

It is preferred the coating composition contains usually as a binder starches, hydroxyethylcellulose, methylcellulose, carboxymethylcellulose, gelatin, casein, gum arabic, polyvinyl alcohol, diisobutylene/maleic anhydride copolymer salt, styrene/maleic anhydride copolymer salt, ethylene/acrylic acid copolymer salt, styrene/butadiene copolymer emulsion, urea resin, melamine resin or amide resin in an amount of 2 to 40 weight %, more preferably 5 to 25 weight % based on the total solid content.

Furthermore, various additives can be added to the coating composition and they include, for example, dispersants such as sodium dioctylsulfosuccinate, sodium dodecylbenzenesulfonate, sodium lauryl sulfate and fatty acid metal salts, defoamers, fluorescent dyestuffs and coloring dyestuffs.

Inorganic pigments such as kaolin, clay, talc, calcium carbonate, calcinated clay, titanium oxide, diatomaceous earth, fine anhydrous silica particles and activated clay may be also added to the coating composition to eliminate the adhesion of smudges on the recording head. Dispersions or emulsions of stearic acid, polyethylene, carnauba wax, paraffin wax, zinc stearate, calcium stearate or ester wax may be also added to prevent sticking when contacted with the thermal head.

Furthermore, if required, fatty acid amides such as stearic acid amide, stearic methylenebisamide, oleamide, palmitamide and coconut fatty acid amide; hindered phenols such as 2,2'-methylenebis(4-methyl-6-tert-butylphenol), 4,4'-butylidenebis(6-tert-butyl-3-methylphenol) and 1,1,3-tris(2-methyl-4-hydroxy-5-tert-butylphenyl)butane; ethers such as 1,2-bis(phenoxy)ethane, 1,2-bis(3-methylphenoxy)ethane, 1-phenoxy-2-(4-methylphenoxy)ethane, 2-naphthol benzyl ether, 1,4-dimethoxynaphthalene and 1,4-diethoxynaphthalene; esters such as dibutyl terephthalate, dibenzyl terephthalate and phenyl 1-hydroxy-2-naphthoate; and ultraviolet absorbers such as 2-(2'-hydroxy-5'-methylphenyl)benzotriazol and 2-hydroxy-4-benzyloxybenzophenone; p-benzyl-biphenyl and various known heat-fusible materials may be used in combination as the sensitizers.

Image preservation improvers may be used in combination according to the purpose to further improve the image preservation unless they deteriorate the effect. Typical examples of such image preservation improver include epoxy compounds such as 1,4-diglycidyloxybenzene, 4,4'-diglycidyloxydiphenylsulfone, diglycidyl terephthalate and bisphenol A type epoxy resin; hindered phenol compounds such as 2,2'-methylenebis(4-methyl-6-tert-butylphenol), 2,2'-methylene-bis(4-ethyl-6-tert-butylphenol), 2,2'-ethylidenebis(4,6-di-tert-butylphenol), 4,4'-thiobis(3-methyl-6-tert-butylphenol), 4,4'-thiobis(2-methyl-6-tert-butylphenol), 4,4'-butylidenebis(6-tert-butyl-m-cresol), 1,1,3-tris(2-methyl-4-hydroxy-5-cyclohexylphenyl)butane, 1,1,3-tris(2-methyl-4-hydroxy-5-tert-butylphenyl)butane, 4,4'-thiobis(3-methylphenol), 4,4'-dihydroxy-3,3',5,5'-tetrabromodiphenylsulfone, 4,4'-dihydroxy- 3,3',5,5'-tetramethyldiphenylsulfone, 2,2'-bis(4-hydroxy-3,5-dibromophenyl)propane, 2,2bis(4-hydroxy-3,5-dichlorophenyl)propane and 2,2-bis(4-hydroxy-3,5-dimethylphenyl)propane; 1-[α-methyl-α-(4'-hydroxyphenyl)ethyl]-4-[α', α-bis(4''-hydroxyphenyl)ethyl]benzene, N,N'-di-2-naphthyl-p-phenylenediamine and sodium 2,2'-methylenebis-(4,6-di-tert-butylphenyl)phosphate.

According to the present invention, the image preservation can be improved by forming a protective layer on the heat-sensitive recording layer. Various binders mentioned above can be exemplified as the water-soluble or water-dispersible polymers used for the formation of such a protective layer. Among them, acetoacetyl group-modified polyvinyl alcohol and carboxyl group-modified polyvinyl alcohol are preferably used because they form rigid films by using together with a water-proofing agent and a crosslinking agent.

Pigments can be added in the protective layer if required to improve recordability and to eliminate sticking. They include, for example, inorganic pigments such as calcium carbonate, zinc oxide, aluminum oxide, titanium dioxide, silicon dioxide, aluminum hydroxide, barium sulfate, zinc sulfate, talc, kaolin, clay, calcinated kaolin and colloidal silica and organic pigments such as styrene microball, Nylon powder, polyethylene powder, urea-formaldehyde resin filler and raw starch particles. The preferred amount used is generally in the range of 5 to 500 parts by weight based on 100 parts by weight of the resin component.

Furthermore, various additives including lubricants such as zinc stearate, calcium stearate, polyethylene wax, carnauba wax, paraffin wax and ester wax; surface active agents (dispersants, wetting agents) such as sodium dioctylsulfosuccinate; defoaming agents, potassium alum, water-soluble polyvalent salts such as calcium acetate can be also added if required in the coating composition forming the protective layer. Curing agents such as glyoxal, boric acid, dialdehyde starch and epoxy compounds can be also added to further improve water resistance.

The method for forming the heat-sensitive recording layer and the protective layer in the heat-sensitive recording material of the invention is not particularly restricted and they can be formed by well-known and commonly used methods. For example, the coating equipment may be selected from an air knife coater, a blade coater, a bar coater, a gravure coater, a curtain coater and the like.

The amount of the coating composition applied is also not particularly restricted and it is preferred that the coating composition for the heat-sensitive recording layer is usually in the range of 2 to 12 g/m$^2$, more preferably 3 to 8 g/m$^2$, on dry basis. The amount of the coating composition for the protective layer is preferably controlled within the range of 0.1 to 10 g/m$^2$, more preferably 0.5 to 7 g/m$^2$, as an amount higher than 10 g/m$^2$ remarkably lowers the recording sensitivity of the heat-sensitive recording material. It is preferred that the opacity of the resultant heat-sensitive recording material is not higher than 60%.

Figure 1:
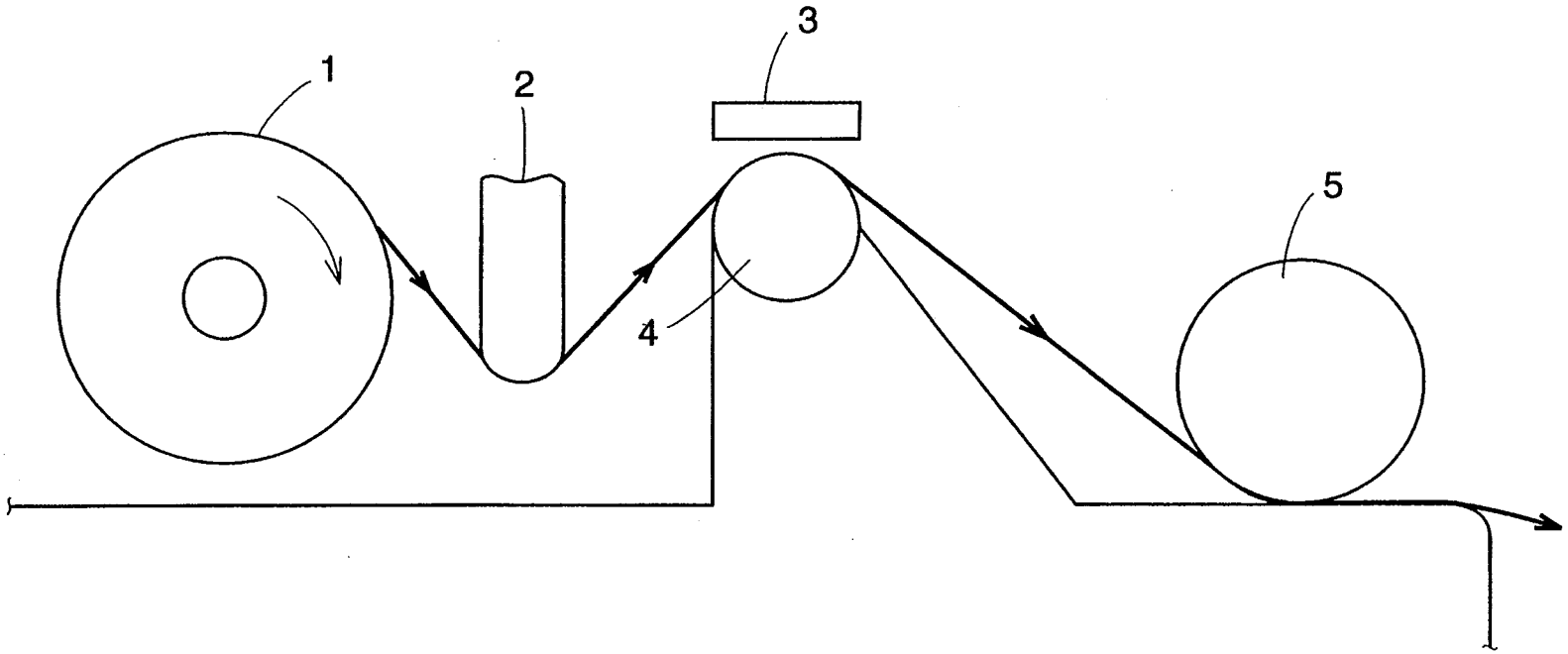
FIG. 1 shows a sectional view of the paper feed portion of a wide thermal plotter.

In the wide thermal plotter, a heat-sensitive recording material 1 given proper tension with a tension bar 2 is passed between a thermal head 3 and a platen roll 4 by driving a driving roll 5.

PREFERRED EMBODIMENT OF THE INVENTION

The following examples serve to illustrated the invention in more detail although the invention is not limited to the examples. Unless otherwise indicated, parts and % signify parts by weight and % by weight, respectively.

EXAMPLE 1

① Preparation of Synthetic Paper A 20 parts of a high density polyethylene having a melt index (referred to as "MI" hereinafter) of 1.0 in powder form was mixed with 80 parts of a polypropylene (MI=0.8) in a super mixer and the mixture was granulated in a granulator. The obtained pellets were hot-mixed in an extruder set at 270° C. and extruded from a die and cooled below 40° C. by a cooling unit to prepare an undrawn film. The undrawn film was drawn 6 times by a longitudinal drawing machine.

A composition prepared by mixing 10 parts of clay with 90 parts of a polypropylene (MI=4.0) was laminated by extruding on one side of the longitudinally uniaxially drawn film prepared above and then the laminated film was drawn 7 times transversely at 145° C. and cooled to room temperature at the drawn condition and the edge was cut off and the laminated and drawn sheet was wound.

The obtained sheet, namely Synthetic Paper A, had a laminated structure consisting of a biaxially drawn film layer of 60 μm thick and a uniaxially drawn film layer of 10 μm thick. The smoothness of the surface of the biaxially drawn film layer and the surface of the uniaxially drawn film layer was respectively 2200 seconds and 350 seconds and the opacity of the laminated film was 12

② Preparation of Dispersion A:

A composition consisting of 10 parts of 3-(N-ethyl-N-isoamyl)amino-6-methyl-7-phenylaminofluoran, 20 parts of 1,2-bis(3-methylphenoxy)ethane, 20 parts of 5% aqueous solution of methylcellulose and 40 parts of water was pulverized by a sand mill to an average particle size of 2 μm.

③ Preparation of Dispersion B:

A composition consisting of 30 parts of 4,4'-isopropylidenediphenol, 40 parts of 5% aqueous solution of methylcellulose and 20 parts of water was pulverized by a sand mill to an average particle size of 2 μm.

④ Formation of a heat-sensitive recording layer:

90 parts of Dispersion A, 90 parts of Dispersion B, 30 parts of a silicon oxide pigment and 250 parts of 10% aqueous solution of polyvinyl alcohol were mixed together and stirred to prepare a coating composition.

The coating composition thus prepared was applied on the surface of the above-mentioned Synthetic Paper A having a smoothness of 2200 seconds in an amount of 5.0 g/m$^2$ on dry basis and then dried to form a heat-sensitive recording layer.

⑤ Formation of a protective layer:

150 parts of 10 % aqueous solution of acetoacetyl group-modified polyvinyl alcohol (Trade Name: Gosefimer Z-200, manufactured by Nippon Gosei Kagaku Co.), 15 parts of kaolin (Trade Name: UW-90, manufactured by EMC Co.), 6 parts of 30% aqueous dispersion of zinc stearate and 30 parts of water was mixed together and stirred to obtain a coating composition. The coating composition was applied on the heat-sensitive recording layer in an amount of 5 g/m$^2$ on dry basis and then dried to prepare a heat-sensitive recording material having a protective layer.

EXAMPLE 2

① Preparation of Synthetic Paper B:

Synthetic Paper B was prepared in the same manner as in Example 1 except that 95 parts of a polypropylene (MI=4.0) and 5 parts of calcium carbonate were used in place of 90 parts of a polypropylene (MI=4.0) and 10 parts of clay in the preparation of Synthetic Paper A in Example 1.

Thus obtained Synthetic Paper B had a laminated structure consisting of a biaxially drawn film layer of 60 μm thick and a uniaxially drawn film layer of 10 μm thick. The smoothness of the surface of the biaxially drawn film layer and the surface of the uniaxially drawn film layer was respectively 4000 seconds and 800 seconds and the opacity of the laminated film was 18%.

(2) Formation of a heat-sensitive recording layer and a protective layer:

A heat-sensitive recording layer and a protective layer were successively formed on the surface of the above-mentioned Synthetic Paper B having a smoothness of 4000 seconds in the same manner as in Example 1 to prepare a heat-sensitive recording material.

EXAMPLE 3

(1) Preparation of Synthetic Paper C:

Synthetic Paper C was prepared in the same manner as in Example 1 except that 95 parts of a polypropylene (MI=4.0) and 5 parts of kaolin were used in place of 90 parts of a polypropylene having a MI of 4.0 and 10 parts of clay in the preparation of Synthetic Paper A in Example 1.

Thus obtained Synthetic Paper C had a laminated structure consisting of a biaxially drawn film layer of 50 μm thick and a uniaxially drawn film layer of 10 μm thick. The smoothness of the surface of the biaxially drawn film layer and the surface of the uniaxially drawn film layer was respectively 8000 seconds and 450 seconds and the opacity of the laminated film was 11%.

(2) Formation of a heat-sensitive recording layer and a protective layer:

A heat-sensitive recording layer and a protective layer were successively formed on the surface of the above-mentioned Synthetic Paper C having a smoothness of 8000 seconds in the same manner as in Example 1 to prepare a heat-sensitive recording material.

EXAMPLE 4

(1) Preparation of Synthetic Paper D (1) Substrate layer (A)

5 parts of calcium carbonate having an average particle size of 2 μm was mixed with 95 parts of a polypropylene (MI=0.8) in a super mixer and the mixture was granulated in a granulator. The resultant pellets were hot-mixed in an extruder set at 270° C. and extruded from a die and cooled below 40° C. by a cooling unit to prepare an undrawn film. The undrawn film was heated to 145° C. and then drawn 6 times by a longitudinal drawing machine.

(2) Paperlike layers (B), (C)

A mixture (a) of 98 parts of a polypropylene (MI=4.0) with 2 parts of calcium carbonate having an average particle size of 1.5 μm and a mixture (b) of 75 parts of a polypropylene (MI=4.0) with 25 parts of calcium carbonate having an average particle size of 1.5 μm were respectively hot-milled in a separate extruder at 270° C. and then extruded and laminated on both sides of the substrate layer sheet 6 times drawn longitudinally prepared by the above (1) and then the triple-laminated product was heated to 185° C. and then drawn transversely 7.5 times to prepare a triple-layer film.

The triple-layer film, namely Synthetic Paper, had a laminated structure consisting of the front paperlike layer (B) prepared by the mixture (a) which was a uniaxially drawn film layer of 10 μm thick, the substrate layer (A) which was a biaxially drawn film layer of 50 μm thick and the back paperlike layer (C) prepared by the mixture (b) which was a uniaxially drawn film layer of 10 μm thick. The smoothness of the surface of the paperlike layers (B) and (C) was respectively 2500 seconds and 300 seconds and the opacity of the laminated film was 10%.

(2) Formation of a heat-sensitive recording layer and a protective layer:

A heat-sensitive recording layer and a protective layer were successively formed on the surface of the above-mentioned synthetic paper D having a smoothness of 2500 seconds in the same manner as in Example 1 to prepare a heat-sensitive recording material.

EXAMPLE 5

A heat-sensitive recording material was prepared in the same manner as in Example 4 except that a mixture of 60 parts of a polypropylene (MI=4.0) with 40 parts of calcium carbonate was used instead of the mixture (b) to prepare the paperlike layer (C) and each of the paperlike layers (B) and (C) had a thickness of 5 μm. The smoothness of the paperlike layer (C) was 280 seconds and the opacity of the laminated film was 9%. Comparative Example 1

A heat-sensitive recording material was prepared in the same manner as in Example 1 except that a synthetic paper of laminated structure [Trade Name: FPG-80, manufactured by Oji Yuka Goseishi Co., smoothness: 400 seconds on both sides, opacity: 100%, thickness: 80 μm] was used instead of Synthetic Paper A.

Comparative Example 2

A heat-sensitive recording material was prepared in the same manner as in Example 1 except that a biaxially drawn polypropylene film [Trade Name: P-2264, manufactured by Toyo Boseki Co., smoothness: 10000 seconds or higher on both sides, opacity: 2%, thickness: 60 μm] was used instead of Synthetic Paper A.

Comparative Example 3

A heat-sensitive recording material was prepared in the same manner as in Example 1 except that a synthetic paper of laminated structure [Trade Name: TPG-60, manufactured by Oji Yuka Goseishi Co., smoothness: 2500 seconds on both sides, opacity: 30%, thickness: 60 μm] was used instead of Synthetic Paper A.

The following evaluation tests were made on thus obtained eight heat-sensitive recording materials. The results are shown in Table 1.

(1) Recorded image density and fine line reproducibility:

An image was recorded on each heat-sensitive recording material by using a thermal plotter [G9825 Model (AO/E), manufactured by Oce Graphics Co.] and the color density of the resultant image was measured by using a Macbeth Densitometer [RD-914, manufactured by Macbeth Co.] in visual mode. The reproducibility of the fine line in the recorded image was evaluated macroscopically.

[Criteria]

○: The fine line portion was reproduced truly.

Δ: The fine line was broken partly.

(2) Conveyability of recording materials:

The conveyability was evaluated by using two thermal plotters [G9825 Model (AO/E), manufactured by Oce Graphics Co. and LTX-320, manufactured by Rholand DG Co.].

[Criteria]

◎: The recording material was smoothly conveyed.

○: The recording material was conveyed with no substantial difficulty.

x: The recording material was abnormally conveyed to give no normal recording.

③ Adaptability for diazo print:

The adaptability for diazo print was evaluated by using a diazo duplicator [Superdry 100, manufactured by Ricoh Co.] using each of the recorded products as an original.

[Criteria]

○: No problem in practical use.

x: No sharp duplicate was obtained even though the duplicating condition was variously changed.

TABLE 1

| | Fine line reproducibility | Conveyability | Adaptability for diazo print |
|---|---|---|---|
| Example 1 | ○ | ◎ | ○ |
| Example 2 | ○ | ◎ | ○ |
| Example 3 | ○ | ◎ | ○ |
| Example 4 | ○ | ◎ | ○ |
| Example 5 | ○ | ◎ | ○ |
| Comp. Ex. 1 | Δ | ○ | x |
| Comp. Ex. 2 | — | x | — |
| Comp. Ex. 3 | Δ | x | x |

As apparent from the results shown in Table 1, the heat-sensitive recording material according to the invention could give a recorded material useful as a secondary original for diazo duplication and showed good recording runnability and in addition had an excellent recording quality.

What is claimed is:

1. A heat-sensitive recording material in which a heat-sensitive recording layer is provided on a synthetic paper having a laminated structure, characterized in that said synthetic paper has a front surface having a smoothness in accordance with JIS P-8119 of not less than 2000 seconds on which said heat-sensitive recording layer is provided, and a back surface having a smoothness in accordance with JIS P-8119 of not more than 1000 seconds, and has an opacity in accordance with JIS P-8138 of not higher than 40%.

2. A heat-sensitive recording material according to claim 1, in which said synthetic paper is of a laminated structure constituted of two thermoplastic film layers, the front layer of which contains 0 to 10% by weight of fine inorganic powders and has a thickness of 30 to 250 μm, and the back layer of which contains 5 to 50% by weight of fine inorganic powders and has a thickness of 1 to 20 μm.

3. A heat-sensitive recording material according to claim 2, in which said front layer is biaxially drawn and said back layer is uniaxially drawn.

4. A heat-sensitive recording material according to claim 1, in which said synthetic paper has a laminated structure constituted of a basic layer and two additional layers respectively laminated on the front and back surfaces of the basic layer, the basic layer being a thermoplastic resin film containing 0 to 10% by weight of fine inorganic powders, the front additional layer being a thermoplastic resin film containing 0 to 5% by weight of fine inorganic powders, and the back additional layer being a thermoplastic resin film containing 5 to 50% by weight of fine inorganic powders, and the heat-sensitive recording layer is formed on the front additional layer.

5. A heat-sensitive recording material according to claim 4, in which the thermoplastic resin film of said basic layer is biaxially drawn and the thermoplastic resin films of said additional layers are uniaxially drawn.

6. A heat-sensitive recording material according to claim 4, in which the basic layer has a thickness of 30 to 250 μm.

7. A heat-sensitive recording material according to claim 4 or 6, in which each of the additional layers has a thickness or 1 to 20 μm.

8. A heat-sensitive recording material according to claim 2 or 4 in which the fine inorganic powders comprised in said synthetic paper has a particle size of not larger than 12 μm.

* * * * *